United States Patent [19]

Shiraishi et al.

[11] 4,358,263

[45] Nov. 9, 1982

[54] PRESS APPARATUS

[75] Inventors: Motoatsu Shiraishi, Sakado; Tatsushi Matsuda, Kawagoe; Masao Sano, Sayama, all of Japan

[73] Assignee: Honda Giken Kogyo Kabushiki Kaisha, Tokyo, Japan

[21] Appl. No.: 286,522

[22] Filed: Jul. 24, 1981

[30] Foreign Application Priority Data

Jul. 26, 1980 [JP] Japan ..... 55-105914

[51] Int. Cl.[3] ..... B29C 17/00

[52] U.S. Cl. ..... 425/397; 425/DIG. 48

[58] Field of Search ..... 425/388, 394, 397, DIG. 48

[56] References Cited

U.S. PATENT DOCUMENTS

| | | | |
|---|---|---|---|
| 3,025,566 | 3/1962 | Kostur | 425/DIG. 48 |
| 3,156,012 | 11/1964 | Hritz | 425/DIG. 48 |
| 3,466,706 | 9/1969 | Asano | 425/DIG. 48 |
| 3,659,991 | 5/1972 | Diamond | 425/397 X |

*Primary Examiner*—J. Howard Flint, Jr.

*Attorney, Agent, or Firm*—Armstrong, Nikaido, Marmelstein & Kubovcik

[57] ABSTRACT

A press of improved moldability and operation efficiency, including an upper movable die having a concave bottom surface, a lower, stationary arc having a convex top surface conforming to the concave bottom surface of the upper die, a blank holder arranged around the lower die for vertical sliding movement, and a blank support lever arm pivotally mounted on top of the blank holder. The blank holder is normally held raised by cushion means in such a position that its top surface is lower than the crest of the convex top surface of the lower die. The blank support lever arm is normally biased to a horizontal position to support a blank in a horizontal position in co-operation with the crest of the lower die and is tilted down by the upper die in downstroke movement out of its path, allowing the blank to be pressed down.

6 Claims, 4 Drawing Figures

PRESS APPARATUS

BACKGROUND OF THE INVENTION

1. Field of the Invention

This invention relates generally to press apparatuses and, more particularly, to those of the type including a lower, stationary die having a convex top surface and an upper die arranged above the lower die for vertical movement relative thereto and having a concave bottom surface facing opposite to and conforming to the convex top surface of the lower die.

2. Description of the Prior Art

In use of this type of press apparatus, when a blank is fed on to the convex surface of the lower die, it is necessary to hold the blank in a horizontal position in order to prevent its dislocation and to enhance its moldability, thereby ensuring good appearance to the product obtained.

In prior art practice, it has been usual to hold the blank horizontal by placing it on an upwardly spring-biased pusher pin whose top end lies at the same level as the crest of the convex top surface of the lower die. Such pusher pin is contracted against the spring bias as the blank is pressed down to form but is again extended under the spring bias as the upper die starts to rise after the blank has been formed. The product formed, therefore, is tilted, being lifted on one side thereof by the pusher pin, and the angle of tilt of the product tends to vary piece by piece. This forms a practical disadvantage that any stable and efficient work-discharging operation can hardly be obtained even with an automatic discharger employed therefor in connection with the press apparatus.

SUMMARY OF THE INVENTION

In view of the above, the present invention has for its object the provision of a new and improved press apparatus of the type concerned which is designed not only to support a blank as fed onto the lower die is held in a horizontal position but also to keep the product formed on the lower die from being tilted to any extent when released therefrom.

To attain this objective, the present invention provides a press apparatus comprising: a lower stationary die having a convex top surface; an upper die arranged above the lower die for vertical movement relative thereto and having a concave bottom surface facing opposite to and conforming to the convex top surface of the lower die; a blank holder arranged around the lower die for vertical sliding movement relative thereto and normally urged by cushion means to a top limit position in which the top surface of the blank holder is held at a level lower than the crest of the convex top surface of the lower die; and a blank support lever arm mounted on the top surface of the blank holder for pivotal movement in a vertical plane and normally urged to a horizontal position to support a blank in a horizontal position in co-operation with the crest of the convex top surface of the lower die, said blank support lever arm being arranged so as to be tilted down by the upper die out of the path of down-stroke movement thereof to allow the blank to be pressed down.

The above and other objects, features and advantages of the present invention will become more apparent from the following detailed description of the invention when taken in conjunction with the accompanying drawings, which illustrate a presently preferred embodiment of the invention.

DESCRIPTION OF THE PREFERRED EMBODIMENT

Figure 1:
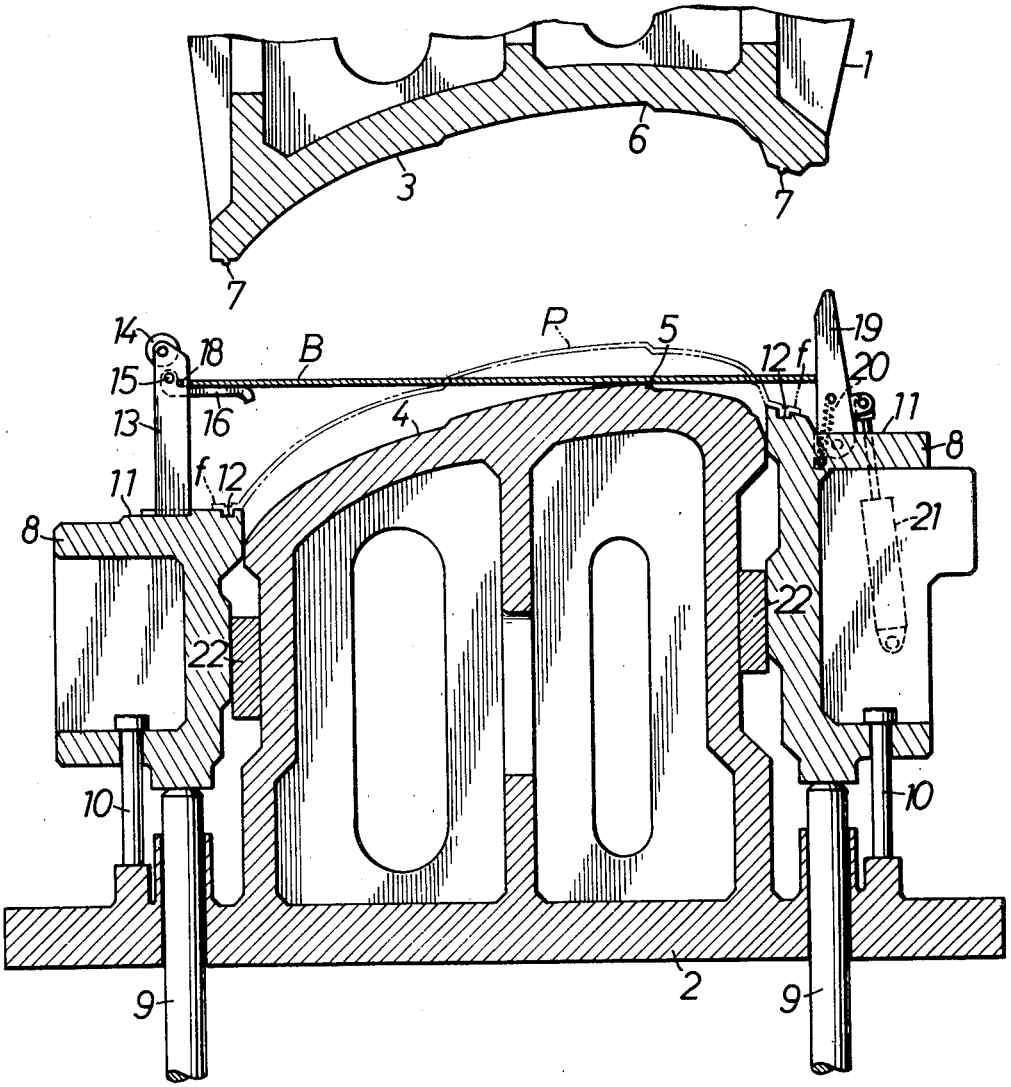
FIG. 1 is a side elevational view, in a vertical cross section of a press apparatus embodying the present invention and showing the upper die as held in its normal, top position above the lower die.

Referring to FIGS. 1 to 4, reference numeral 1 indicates an upper vertically movable die arranged above a lower, stationary die 2 and formed at the bottom with a concave die surface 3. The lower die 2 is formed at the top with a convex die surface 4 which faces opposite to and conforms to the concave surface 3 of upper die 1. As clearly seen in FIG. 1, the concave surface 3 of upper die 1 has its point of maximum depth 5 located off-centered to the right, the convex surface 4 of lower die 2 having its crest or point of maximum height 6 located off-centered to the right. The left-hand side edges of the concave and convex surfaces 3 and 4 of the respective dies 1 and 2 are each extended downwardly to a level lower than that of the right-hand side edge of the respective die surface 3 and 4. Formed on the bottom surface of the upper die 1 around the periphery thereof is a downwardly projecting, annular bead 7.

Arranged around the lower die 2 is a blank holder 8 which is resiliently supported on a plurality of cushion members such as pins 9 which are slidably fitted through the base flange portion of the lower die 2 and upwardly urged as by spring means, not shown. The blank holder 8 has a bottom flange portion through which a plurality of headed stop pins 10 fixedly mounted on the base flange of lower die 2 are slidably fitted and is normally held in abutting engagement with the stop pins 10, as shown, assuming such an upper limit position that its top surface 11 lies below the level of the crest 5 of lower die 2. In operation, a blank B is first roughly formed on the convex surface 4 of lower die 2 and then clamped to form between the top surface of blank holder 8 and the peripheral edge portion of upper die 1, as will be described later in detail. An annular groove 12 is formed in the top end surface of blank holder 9 in a position opposite to the annular bead 7 on the upper die 1 to serve the purpose of firmly gripping the peripheral edge portion of blank B in co-operation with the bead 7.

Figure 2:
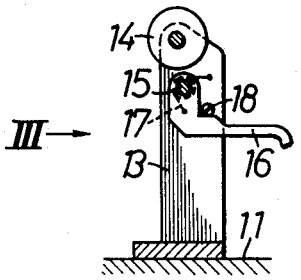
FIG. 2 is a slightly enlarged side view of the blank support lever arm shown in FIG. 1.
Figure 3:
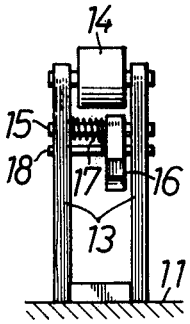
FIG. 3 is a view of same, looking in the direction of the arrow III in FIG. 2.
Figure 4:
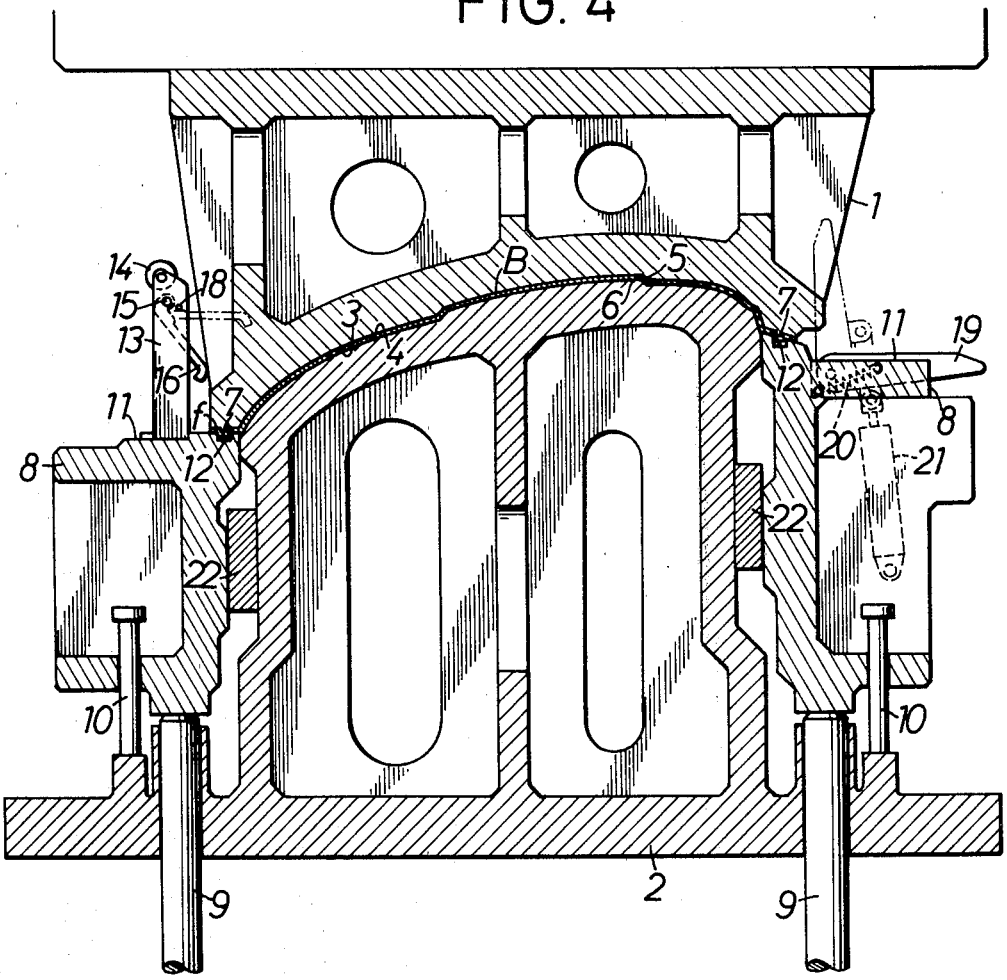
FIG. 4 is a view similar to FIG. 1, showing the press apparatus with the upper die lowered into pressure engagement with the lower die.

As illustrated in FIGS. 1 to 3, there are provided on the blank feed side or the left-hand side of the apparatus, as viewed in FIG. 1, a support post 13 which consists of a pair of upstanding members fixedly mounted on the top surface 11 of blank holder 8 in a position not to interfere with the upper die 1 in stroking movement. A blank guide roller 14 is rotatably mounted on the support post 13 at its top end in a position not protruding laterally inside thereof. Also, an L-shaped blank support lever arm 16 is mounted on the support port 13 by means of a pivot shaft 15 and pivotally movable in a vertical plane between an upper, horizontal position in which its top surface extends horizontally at the same level as the crest 5 of lower die 2 and a lower, inoperative position between the two support post members 13. A coiled wire spring 17, encircling the pivot shaft 15, is anchored at one end to the support post 13 and at the other end to the blank support lever arm 16 to bias the latter counter-clockwise, as viewed in FIGS. 1 and 2. Reference numeral 18 indicates a stop pin mounted on the support post 13 to normally hold the lever arm 16 in its raised, horizontal position against the bias of coiled wire spring 17.

As will readily be noted, such blank support means 13-18 may be provided in a set of two or more, as required.

Mounted on the right-hand side portion of the top surface of blank holder 8 is a blank-positioning stop lever 19 which is pivotally movable in a vertical plane between a vertical and a horizontal position. As illustrated, a blank B as fed on to the lower die 2 is engageable at its forward end with the stop lever 19 in the vertical position to be properly positioned on the lower die 2. Reference numeral 20 indicates a tension spring arranged between the stop lever 19 and blank holder 8 in order to hold the stop lever 19 in its vertical position. It is to be noted that in down stroke movement of the upper die 1 the stop lever 19 is first driven clockwise thereby through a predetermined angle while extending the tension spring 20, thereafter rotating in the same direction under the bias of the latter to attain its horizontal position.

To restore the stop lever 19 to its vertical position, a pneumatic or hydraulic cylinder unit 21 arranged between the blank holder 8 and stop lever 19 is activated to extend. Reference numeral 22 indicates wear plate means interposed between the blank holder 8 and lower die 2.

Description will next be made of the operation of the embodiment of the present invention.

Normally, in the inoperative state of the apparatus, the upper die 1 is held in its top position, the blank support lever arm 16 and stop lever 19 being held in the horizontal and vertical positions, respectively, as illustrated in FIG. 1.

In operation, a blank B, of the length slightly smaller than the distance between the support post 13 and stop lever 19, is carried into the apparatus slidingly over the guide roller 14 so as to come into abutting engagement with the stop lever 19 and held in a horizontal position resting on the upper surface of blank support lever arm 16 and the crest 5 of lower die 2. Subsequently, upon descent of the upper die 1, first the left-hand side edge thereof comes into engagement with the blank B to press down the latter, causing the blank support lever arm 16 to start to turn downwardly. As the upper die 1 continues to descend, the lever arm 16 is further turned through the medium of the blank B until it is retracted into the spacing between the post members 13. On the other hand, the stop lever 19 is actuated by the descending upper die 1 so as to assume its horizontal position, causing the cylinder unit 21 to retract. Immediately thereafter, the blank B is clamped between the upper die 1 and blank holder 8 in a state roughly formed on the convex surface 4 of lower die 2. In the meantime, the blank support lever arm 16 emerges from between the post members 13 to engage the adjacent side surface of upper die 1 at the free end of the lever arm. Subsequently, as the upper die 1 and blank holder 8 descend together, the blank B is finally formed between the concave surface 3 of upper die 1 and the convex surface 4 of lower die 2.

After the blank has been formed completely, the upper die 1 starts to rise allowing the blank holder 8 to rise under the bias of cushion pins 9 so that the formed product P is released apart from the convex surface 3 of lower die 2, the peripheral edge portion f of the product P remaining held on the top surface of blank holder 8, as indicated in FIG. 1 by the dash-double-dot lines. As the upper die 1 continues to rise, the blank support lever arm 16 restores its raised, horizontal position automatically under the bias of spring 17. The stop lever 19 is restored to its vertical, operative position by means of the cylinder unit 21 after the product P has been discharged from the apparatus.

It will readily be appreciated from the foregoing description that, according to the present invention, any blank dislocation is effectively prevented and good moldability ensured to result in enhanced product appearance because of the provision on the blank holder of a spring-biased blank support lever arm that is normally held horizontal to support a blank in a horizontal position in cooperation with the crest of the convex top surface of the lower die. Also, since the blank holder is supported on cushion means in such a manner that its top surface normally lies below the level of the crest of the lower die, the product formed on the lower die is released apart therefrom while securely resting on the top surface of the blank holder when the upper die starts to rise allowing the blank holder to rise to its normal position. This enables the product to be removed out of the apparatus in stable fashion with use of an automatic discharger and hence an extremely smooth and efficient product-discharging operation.

What is claimed is:

1. A press apparatus comprising: a lower, stationary die having a convex top surface; an upper die arranged above said lower die for vertical movement relative thereto and having a concave bottom surface facing opposite to and conforming to the convex top surface of said lower die; a blank holder arranged around said lower die for vertical sliding movement relative thereto and normally urged by cushion means to a top limit position in which the top surface of said blank holder is held at a level lower than that of the crest of the convex top surface of said lower die; and a blank support lever arm mounted on the top surface of said blank holder for pivotal movement in a vertical plane and normally urged to a horizontal position to support a blank in a horizontal position in co-operation with the crest of the convex top surface of said lower die, said blank support lever arm being arranged so as to be tilted down by said upper die out of the path of down-stroke movement thereof to allow the blank to be pressed down.

2. A press apparatus as claimed in claim 1, in which said blank support lever arm is arranged on said blank holder on that side thereof where a blank is carried into the apparatus.

3. A press apparatus as claimed in claim 1, in which the crest of the convex top surface of said lower die is located off-centered in a direction away from said blank support lever arm.

4. A press apparatus as claimed in any one of claim 1, 2 or 3, in which said blank support lever arm is pivotally mounted on a support post fixed upright to the top surface of said blank holder and on the top of which post a guide roller is provided to support a blank being carried into the apparatus.

5. A press apparatus as claimed in claim 1, in which said blank support lever arm in said horizontal position lies so as to be intersected by the path of downstroke movement of said upper die.

6. A press apparatus as claimed in claim 1, further comprising a blank-positioning stop provided on the top surface of said blank holder in a position opposite to said blank support lever arm.

* * * * *